US005208789A

United States Patent [19]

Ling

[11] Patent Number: 5,208,789

[45] Date of Patent: May 4, 1993

[54] CONDENSER MICROPHONES BASED ON SILICON WITH HUMIDITY RESISTANT SURFACE TREATMENT

[75] Inventor: Chung H. Ling, Singapore, Singapore

[73] Assignee: Lectret S. A., Geneva, Switzerland

[21] Appl. No.: 867,993

[22] Filed: Apr. 13, 1992

[51] Int. Cl.[5] ..... H04R 19/00

[52] U.S. Cl. ..... 367/181; 381/191; 361/322

[58] Field of Search ..... 367/181, 170; 381/168, 381/174, 191, 175; 310/308, 309; 361/322, 313, 305

[56] References Cited

U.S. PATENT DOCUMENTS

| | | | |
|---|---|---|---|
| 3,638,085 | 1/1972 | Tierman | 317/258 |
| 4,464,701 | 8/1984 | Roberts et al. | 361/313 |
| 4,471,405 | 9/1984 | Howard et al. | 361/305 |
| 4,908,805 | 3/1990 | Sprenkeis et al. | 367/181 |

*Primary Examiner*—Brian S. Steinberger
*Attorney, Agent, or Firm*—Fish & Richardson

[57] ABSTRACT

An condenser microphone element including a silicon core, a layer of silicon dioxide thereon, and a layer of tantalum pentoxide thereon.

12 Claims, 1 Drawing Sheet

CONDENSER MICROPHONES BASED ON SILICON WITH HUMIDITY RESISTANT SURFACE TREATMENT

BACKGROUND OF THE INVENTION

The invention relates to silicon dioxide on silicon backplates and condenser microphones employing them.

Miniature condenser microphones can be fabricated by etching single crystal silicon and biased using electrets based on silicon dioxide layers on the silicon. Silicon dioxide has been used for many years in memory devices and shows excellent charge storage properties. However, memory devices store charge at the silicon dioxide—silicon interface and are encapsulated for protection against humidity. Electret microphones store charge at the silicon dioxide—air interface and must be open to the atmosphere.

Silicon dioxide absorbs water at moderate humidity levels. Absorbed water causes surface conduction and loss of charge for electret-biased microphones, which then suffer in performance owing to surface leakage. U.S. Pat. No. 4,908,805, which is hereby incorporated by reference, describes reacting silicon dioxide surfaces with hexamethyl disilazane (HMDS) to form a monomolecular coating of non-polar methyl ($CH_3$) groups to passivate the surfaces so that they do not absorb water.

SUMMARY OF THE INVENTION

I have discovered that a condenser microphone element employing silicon dioxide on a silicon core can be provided with good resistance to adverse environmental conditions by coating the silicon dioxide with a layer of tantalum pentoxide. When the backplate element is charged to act as an electret to provide a built-in bias voltage for a microphone, the tantalum pentoxide layer desirably permits the electret to retain charge under humidity conditions.

In preferred embodiments, the tantalum pentoxide layer is between 0.03 and 0.30 micrometer thick (most preferably between 0.08 and 0.12 micrometer thick), and the silicon dioxide layer is between 0.2 and 2.0 micrometers thick (most preferably about 1.0 to 1.5 micrometers thick).

Preferably the backplate is used with a metallized polymer or silicon diaphragm that is supported by integral supports on the silicon core or a diaphragm of monocrystalline silicon.

Other advantages and features of the invention will be apparent from the following description of the preferred embodiment and from the claims.

DESCRIPTION OF THE PREFERRED EMBODIMENT

The preferred embodiment will now be described.

DRAWINGS

Figure 1:
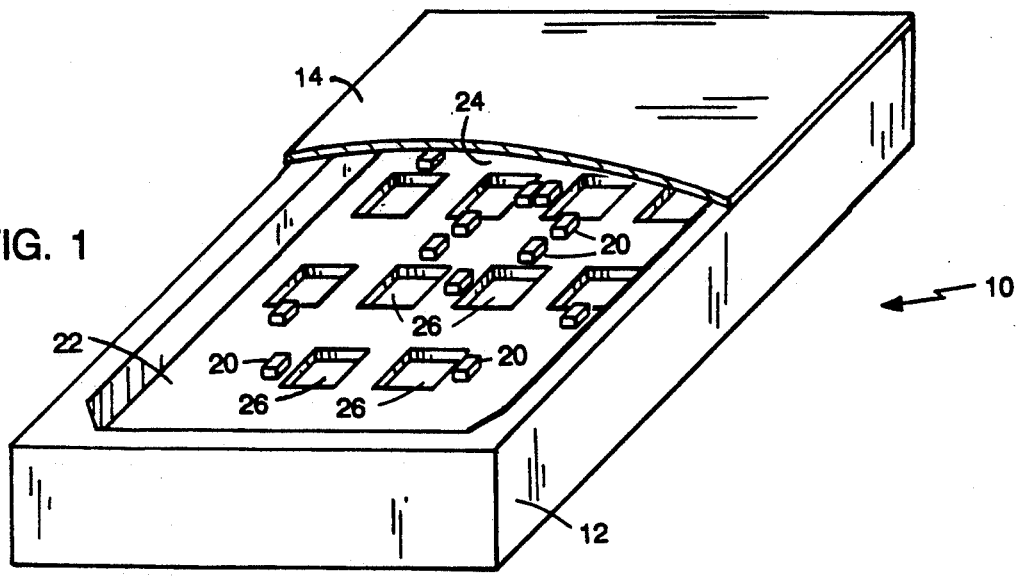
Figure 2A:
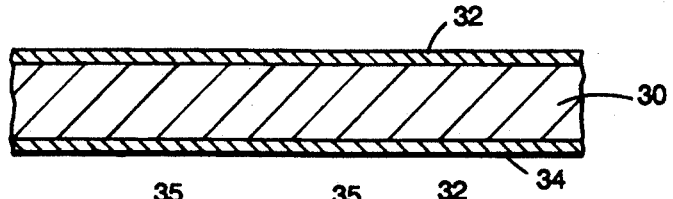
Figure 2B:
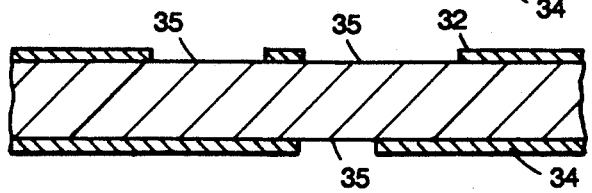
Figure 2C:
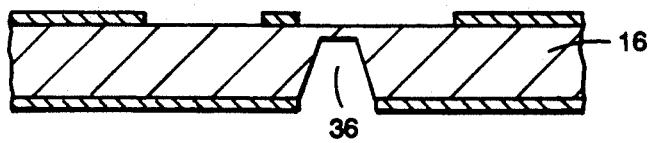
Figure 2D:
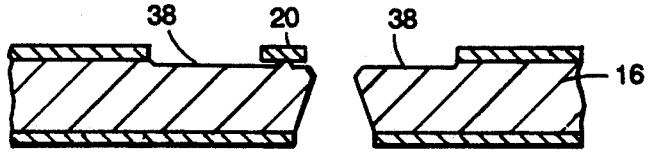
Figure 2E:
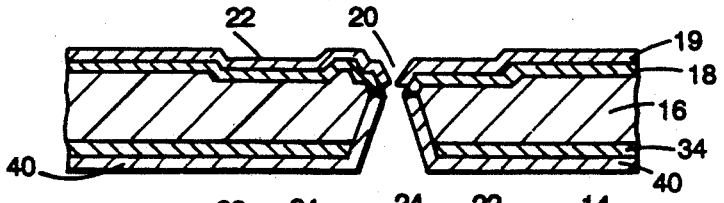
Figure 2F:
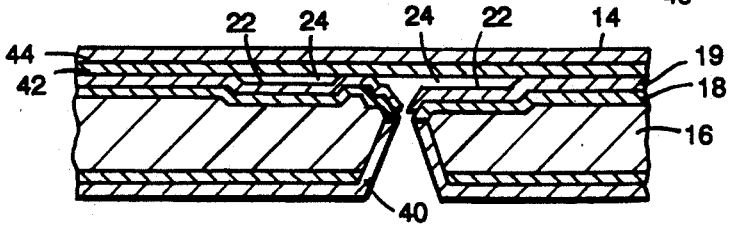

FIG. 1 is a perspective view, partially broken away, of a microphone element according to the invention.

FIGS. *2a–2f* are partial diagrammatic vertical sectional views of the FIG. I microphone element during different stages of manufacture.

STRUCTURE

Referring to FIGS. 1 and *2f*, there is shown microphone element 10, including silicon backplate 12 and diaphragm 14 thereon. Backplate 12 has a silicon core 16 that acts as a back electrode. A charged composite layer of silicon dioxide layer 18 coated with tantalum pentoxide layer 19 is supported on the upper surface of core 16 and acts as an electret. Mesas 20 support diaphragm 14 above surfaces 22, providing air cavity regions 24 between diaphragm 14 and surfaces 22. Openings 26 provide communication between air cavity regions 24 and the region below backplate 12. It should be understood that the microphone element 10 will be placed in a housing which will include an air volume in the region below backplate 12. Diaphragm 14 is made of polyester that carries metallization to provide a movable electrode.

Manufacture

Backplate 12 is made from a wafer cut from single crystal silicon oriented in the (100) plane. The silicon is p-type of 5 ohm-cm resistivity. Wafers 30 (only a portion of a single wafer is shown in FIGS. *2a–2f*) are 7 cm in diameter by 280 micrometers in thickness and are ground flat and polished on both sides. Silicon dioxide layers 32, 34 formed on both (top and bottom) surfaces by standard wet oxidation at 1100° C. to serve as the mask for etching (FIG. *2a*). Then photoresist is applied to both surfaces to serve as the first mask for selective removal of silicon dioxide. Buffered HF is used to open windows 35 in the oxide; then the remaining photoresist is removed (FIG. *2b*). The wafers are mounted in a watertight chuck and etched from one side with hot KOH to form pyramidal holes 36 bounded by the (111) planes, which etch 50 times slower than the (100) plane (FIG. *2c*). The holes are etched from the rear of the backplate, and the etch is stopped about 40 micrometers from the opposite surface.

Next the wafers are etched simultaneously from both sides, forming front air cavity recesses 38 of 18 to 25 micrometer depth while leaving raised diaphragm support structures (FIG. *2d*). A series of flat mesas 20 each having about 60 micrometers width is prepared on the top surface to support the diaphragm at selected points across its surface. The compensation technique (R. Busser, B. N. F. De Rooij, Ext. Abstr., 170th Electrochem, Soc. Meet., San Diego, Calif. 86, 879–830 (1986)) is used to produce mesas 20 in order to obtain steep walls. At the same time, the rear openings 26 are etched through, providing an acoustic path from the front air cavity regions 24 to a larger rear air volume for increased diaphragm compliance.

Next thick coating 18 of silicon-dioxide is formed on the front surface (FIG. *2e*). High temperature oxidation has been found to give oxide films about 1.2 micrometers thick, while low pressure chemical vapor deposition followed by 650° C. densification has been found to give films about 1.4 micrometers thick; either technique is appropriate. Next $Ta_2O_5$ layer 19 is formed on the $SiO_2$ surface by vacuum evaporation of tantalum followed by oxidation at 600° C. Aluminum 40 is metallized onto the surfaces defining openings 26 (FIG. *2e*) to provide electrical contact to the bulk silicon.

The silicon wafers are presawed to facilitate singulation of 3 mm by 3 mm backplate elements and corona poled to produce a negative charge. Polyester film 42 of 1.5 micrometer thickness is gold metallized to provide layer 44 by sputtering. The resulting metallized diaphragm 14 is tensioned for bonding to the wafer via adhesive applied to the bonding areas by tampon printing.

Operation

In operation, the two electrodes provided by silicon core 16 and metallization 44 of diaphragm 14 act as a capacitor that changes in capacitance as the spacing between the electrodes changes owing to vibration of diaphragm 14 caused by sound waves. Because of the electric field caused by the electret, the change in capacitance causes an output signal related to the sound.

Tantalum oxide layer 19 protects $SiO_2$ layer 18 from loss of charge that would otherwise result from humidity and other adverse environmental conditions.

Other embodiments of the invention are within the scope of the following claims.

What is claimed is:

1. A condenser microphone element comprising a backplate including a silicon core and a dielectric layer thereon, said dielectric layer including a layer of silicon dioxide on said silicon core and a layer of tantalum pentoxide on said silicon dioxide layer to protect said silicon dioxide layer from humidity, said dielectric layer having a surface exposed to an air cavity, with said surface spaced from a movable electrode, wherein said movable electrode is a diaphragm of a microphone.

2. The microphone element of claim 1 wherein the silicon dioxide layer is 0.2 to 2.0 micrometers thick.

3. The microphone element of claim 2 wherein the silicon dioxide layer is 1.0 to 1.5 micrometers thick.

4. The microphone element of claim 1 wherein the tantalum pentoxide layer is 0.03 to 0.30 micrometer thick.

5. The microphone element of claim 4 wherein the tantalum pentoxide layer is 0.08 to 0.12 micrometer thick.

6. The microphone element of claim 1 wherein said silicon dioxide layer and said tantalum pentoxide layer are charged to provide an electret.

7. A condenser microphone comprising a backplate including a silicon core and a dielectric layer thereon, said dielectric layer including a layer of silicon dioxide on said silicon core and a layer of tantalum pentoxide on said silicon dioxide layer to protect said silicon dioxide layer from humidity, said dielectric layer having a surface exposed to an air cavity, and a movable electrode supported in spaced relationship with said backplate, wherein said movable electrode is a diaphragm of the microphone, and wherein said movable electrode defines said air cavity between said movable electrode and said dielectric layers.

8. The condenser microphone of claim 7 wherein said diaphragm is a metallized diaphragm.

9. The condenser microphone of claim 7 wherein said diaphragm is a metallized polymer diaphragm.

10. The condenser microphone of claim 7 wherein said diaphragm is a silicon diaphragm.

11. The condenser microphone of claim 7 wherein said core has diaphragm supports formed on one surface and openings through said core.

12. The condenser microphone of claim 7 wherein said silicon dioxide layer and said tantalum pentoxide layer are charged to provide an electret.

* * * * *